United States Patent [19]

Jedo et al.

[11] 4,204,949

[45] May 27, 1980

[54] DEVICE FOR WET CLASSIFICATION OF A MIXTURE OF SOLID COMPONENTS ACCORDING TO SIZE

[75] Inventors: Antoni Jedo, Gliwice; Wacław Jachna, Tychy, both of Poland

[73] Assignee: Centralny Osrodek Projektowo-Konstrukcyjny Maszyn Gorniczych KOMAG, Gliwice, Poland

[21] Appl. No.: 967,733

[22] Filed: Dec. 8, 1978

[51] Int. Cl.[2] ..... B07B 1/06

[52] U.S. Cl. ..... 209/250; 209/254; 209/275

[58] Field of Search ..... 209/250, 254, 144, 211, 209/274–277

[56] References Cited

U.S. PATENT DOCUMENTS

| | | | |
|---|---|---|---|
| 2,563,249 | 8/1951 | Koziol | 20/275 |
| 2,658,618 | 11/1953 | Vogel | 209/211 |
| 3,519,130 | 7/1970 | Jachna | 209/234 |

FOREIGN PATENT DOCUMENTS

| | | |
|---|---|---|
| 46606 | 3/1963 | Poland . |
| 48474 | 3/1965 | Poland . |
| 56209 | 12/1968 | Poland . |
| 56220 | 12/1968 | Poland . |
| 1097941 | 5/1968 | United Kingdom . |

*Primary Examiner*—Tim R. Miles

*Attorney, Agent, or Firm*—Haseltine, Lake & Waters

[57] ABSTRACT

The device for wet classification of a mixture of solid components with respect to size, according to the invention, has two circular chutes "2" and "2*a*" situated tangently next to each other at the same level and equipped with one common feeding nozzle "3". In the outer walls of the chutes "2" and "2*a*" in the region of their contact there is a distributing hole "5" in which, opposite the inlet of the feeding nozzle "3", there is the dividing wedge "6". The device has separate sieve planes "1" and "1*a*" fastened to the inner edges of the bottoms of the circular chutes "2" and "2*a*". A vibratory unit "7" is located on the central vertical axis of each sieve plane.

5 Claims, 3 Drawing Figures

DEVICE FOR WET CLASSIFICATION OF A MIXTURE OF SOLID COMPONENTS ACCORDING TO SIZE

Figure 1:
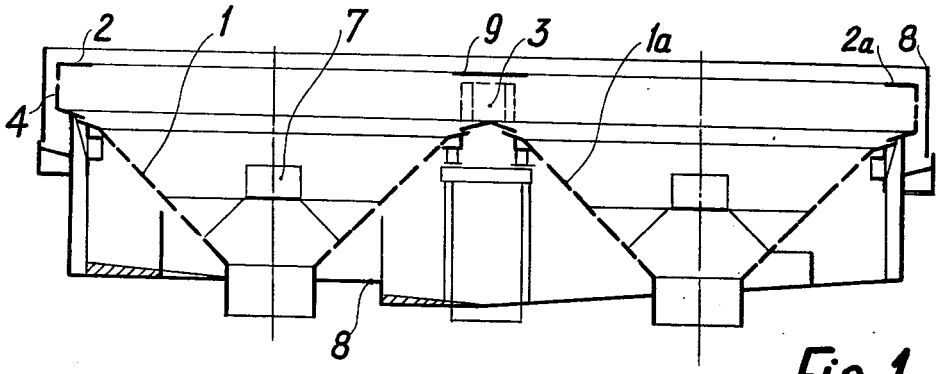

The subject of the invention is a device for wet classification of a mixture of solid components according to size. The device can be applied in mechanical processing of minerals, in building materials industry, and in wood industry.

There is known a device for a wet classification of a mixture of solid components with various specific gravities in a heavy liquid, consisting of a nozzle for feeding the mixture of solid components and heavy liquid to the inlet of a curved chute without external wall, the end portion of the chute entering between two sieve planes. The sieve planes have filter walls consisting of vertical sieve strips descending along a spiral line with decreasing radius. The spiral filter walls are wound in opposite direction. The slot between the lower and upper coil of the filtering wall is connected with the descending spiral plate.

The object of the invention is a universal device of better useful characteristics than the known device, and especially is characterized by higher efficiency and higher capacity at the same hydrostatic pressure of the mixture being classified containing fine grains, and characterized by higher reliability and durability during classification of mixtures containing coarse grains.

The said object is achieved in the device for wet classification of the mixture of solid components according to size, according to the invention, by means of placing two circular chutes tangently placed to each other on the same level. The circular chutes are equipped with one common feeding nozzle whose section is two times bigger than the section of the nozzle in the known device at the same diameter of the sieve planes. In the outer walls of the chutes in the region of their contact there is a distributing hole in which a dividing wedge is situated. The wedge is situated opposite the inlet of the feeding nozzle. To the inner edges of the bottoms of both circular chutes separate sieve planes are fastened. The sieve planes formed by the inversed frustra of cones or truncated pyramids are located in a casing.

Axis of the feeding nozzle is perpendicular to a plane passing through central vertical axes of curvilinear sieve surfaces. The dividing wedge is built in deflectively around the vertical axis. Over the distributing hole there is a hinged cover.

The device according to the invention in comparison with the known device has several advantages revealing during its utilization. Namely, at the same diameter of the sieve stages and at the same feeding pressure as in the known device, the device according to the invention provides for obtaining a capacity twice as high and provides for the possibility of classifying mixtures containing grains of the diameter 1.4 times larger. Then, for the given size of the maximum grain it enables a reduction of the diameter of the sieve segments and a reduction of the feeding pressure by 0.7 times, which contrubutes to a reduction of crushing of coarse grains, and increases the durability of the elements exposed to abrasion.

Classification of a fine-grained mixture in the device according to the invention, at the same quantity of the fed material and at the same feeding pressure as in the known device, proceeds in a layer thinner by a half, which reduces the filtrating action of the layer of the material partly devoid of liquid, and provides for higher effectiveness of the classification process. The increase of the capacity is achieved in this device by means of reducing the losses of energy in the feeding nozzle and on the sieve planes. The device according to the invention is universal, because it can be used both for classification of coarse-grained mixtures and fine-grained mixtures, with high effectiveness, at high capacity. Further advantage of the device is the feature consisting in the sieve planes and the symmetrical segments being built in next to each other, due to which the mixture under classification rotates on them in opposite directions. As during operation the sieve planes undergo unequal wear, they are made of symmetrical segments, which enables the exchange of the sieve planes within one device after a certain period of time. This provides for a long period of utilization of the sieve and for obtaining the classification products of a constant quality. Besides, only one of the two assembled sieve planes can be utilized. Then in the distributing hole an adjustable directing plate should be built in. In order to distribute uniformly the fed mixture into both assembled sieve planes, in the distributing hole a dividing wedge in a shape of a "shoe" is built in. It provides for a distribution of the mixture stream into the circular chutes.

At the classification of mixtures containing very fine grains, the sieve planes mounted next to one another can be equipped with vibrating units of adjustable force extorting oscillation. The whole sieve planes or their segments can be put in oscillating motion, as in the known device.

Figure 2:
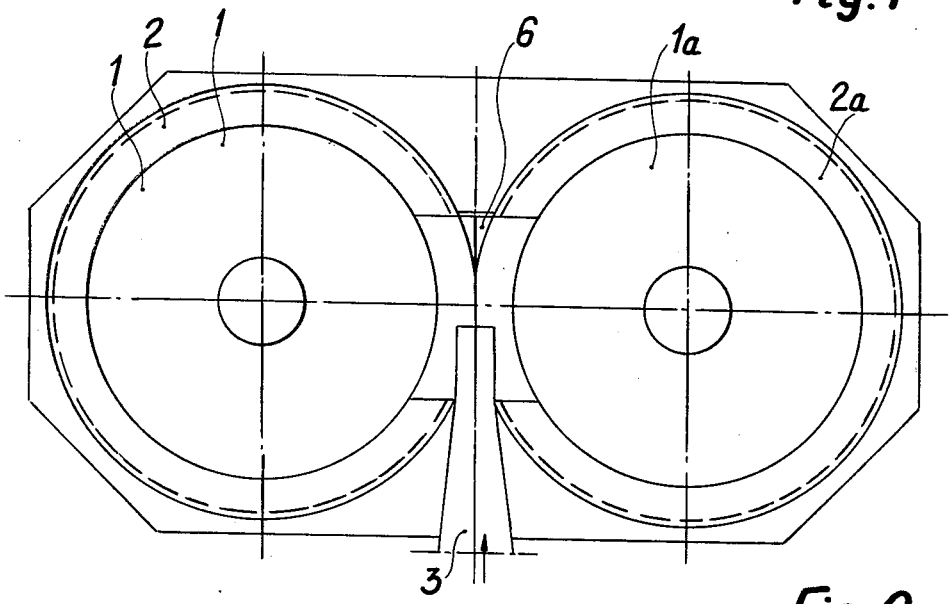
Figure 3:
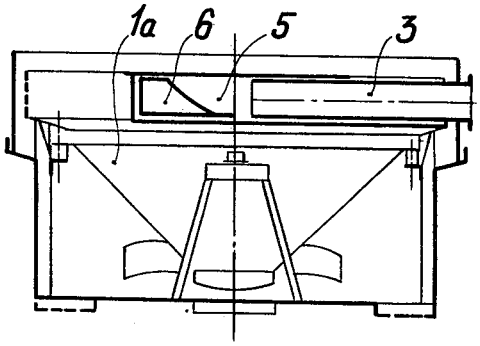

The device according to the invention in the execution example is shown in the drawing, where:

FIG. 1 shows the device in a vertical section passing through the centres of both circular chutes and the segments of the sieve planes, FIG. 2 shows the top view of the device after the removal of the cover over the distributing hole, FIG. 3 shows the device in vertical section along the axis of the feeding nozzle.

The device consists of two circular chutes 2 and 2*a* situated next to each other and on the same level. In the region of contact of the circular chutes, in their outer walls 4 there is the distributing hole 5. Over the portion of the circular chutes, in which the distributing hole 5 is made, there is the hinged cover 9 mounted. Into the space between the cover 9 and the bottom walls of the circular chutes 2 and 2*a*, one common feeding nozzle 3 is inserted, through which the mixture being classified is supplied. The stream of the mixture under classification is divided in the distributing hole 5 by the dividing wedge 6 into two streams flowing away to the circular chutes 2 and 2*a*, from which they flow onto the sieve planes 1 and 1*a*. The device can be equipped with vibratory units 7.

The mesh fraction from the sieve planes 1 and 1*a* is carried away under the effect of gravity through separate holes at the smaller base of the conical sieve segments, while the minus mesh is carried away through a common hole made in the bottom of the casing 8.

What is claimed is:

1. A device for wet classification of solid particles by size, comprising: at least two curvilinear conic sieve planes formed of segments, two horizontal circular chutes situated tangentially and adjacently at an upper level of said sieve planes, a common feeding nozzle tangential to and between said circular chutes, a dividing wedge facing said common feeding nozzle, a distributing hole holding said dividing edge, a vibratory unit located on a central vertical axis of each of said sieve planes, said circular chute being horizontal and lying above the edge of said sieve planes, said solid particles flowing along said sieve planes in a downward direction, part of liquid used in wet classification returning near said common feeding nozzle and being reused, said dividing wedge being swivel-mounted for dividing flow equally.

2. A device as defined in claim 1 wherein the longitudinal axis of said common feeding nozzle is perpendicular to a plane passing through both central vertical axes of said curvilinear conic sieve planes.

3. A device as defined in claim 5 including a deflectable cover above said common feeding nozzle.

4. The device according to claim 1 wherein the axis of the feeding nozzle /3/is situated approximately tangently to the perimeters of the circles determining the circular chutes /2 and 2*a*/.

5. The device according to claim 1 wherein the dividing wedge /6/ is deflectible around the vertical axis.

* * * * *